US012509953B2

(12) United States Patent
Stam et al.

(10) Patent No.: US 12,509,953 B2
(45) Date of Patent: Dec. 30, 2025

(54) METHOD OF CREATING A PLURALITY OF LONGITUDINALLY SEPARATED CIRCUMFERENTIAL DENTS IN A WELLBORE TUBULAR

(71) Applicant: SHELL USA, INC., Houston, TX (US)

(72) Inventors: Walter Stam, Amsterdam (NL); James G Rairigh, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/842,114

(22) PCT Filed: Mar. 9, 2023

(86) PCT No.: PCT/EP2023/055994
§ 371 (c)(1),
(2) Date: Aug. 28, 2024

(87) PCT Pub. No.: WO2023/170200
PCT Pub. Date: Sep. 14, 2023

(65) Prior Publication Data

US 2025/0179891 A1 Jun. 5, 2025

Related U.S. Application Data

(60) Provisional application No. 63/318,952, filed on Mar. 11, 2022.

(51) Int. Cl.
*E21B 29/02* (2006.01)

(52) U.S. Cl.
CPC ..... *E21B 29/02* (2013.01)

(58) Field of Classification Search
CPC ..... E21B 29/00; E21B 29/02; E21B 29/08
See application file for complete search history.

(56) References Cited

U.S. PATENT DOCUMENTS 5,038,683 A * 8/1991 Baker ..... F42B 1/02 102/501
9,038,713 B1 * 5/2015 Bell ..... E21B 29/02 166/55.7

(Continued)

FOREIGN PATENT DOCUMENTS

WO 2023170200 A1 9/2023

OTHER PUBLICATIONS

International Search Report and Written Opinion received for PCT Patent Application No. PCT/EP2023/055994, mailed on Apr. 14, 2023, 8 pages.

(Continued)

*Primary Examiner* — David Carroll
(74) *Attorney, Agent, or Firm* — SHELL USA, INC.

(57) ABSTRACT

An energetics tool is inserted downhole in a wellbore tubular, which has a string of at least two axially separated shaped charges. With this tool N axially separated circumferential dents are created, using a string of only M=(N+1)/2 axially separated charges. N is an odd number of 3 or higher. Two additional axially separated dents may be created for each additional axially separated shaped charge that is added to the string. For example, by simultaneously detonating two shaped charges, it is possible to create three axially separated dents. By simultaneously detonating three shaped charges that are axially separated from each other, it is possible to create five axially separated dents. The shaped charges are contained in charge housings that are mechanically interconnected with a longitudinal connecting rod. The shaped charges are simultaneously detonated, whereby pressure waves from neighboring shaped charges interact to cause the additional dents.

11 Claims, 8 Drawing Sheets

(56) References Cited

U.S. PATENT DOCUMENTS

| | | | | |
|---|---|---|---|---|
| 9,757,796 | B2 | 9/2017 | Sherman et al. | |
| 9,903,010 | B2 | 2/2018 | Doud et al. | |
| 10,150,713 | B2 | 12/2018 | Doud et al. | |
| 11,002,097 | B2 | 5/2021 | Rairigh | |
| 11,015,410 | B2 | 5/2021 | Rairigh | |
| 11,377,927 | B2 | 7/2022 | Ruckert | |
| 2002/0092793 | A1* | 7/2002 | Barker | F42B 39/14 53/445 |
| 2003/0221579 | A1* | 12/2003 | Grattan | F42B 1/02 102/306 |
| 2005/0061506 | A1* | 3/2005 | Grove | E21B 21/085 166/162 |
| 2006/0075888 | A1* | 4/2006 | Yang | F42B 3/08 89/1.14 |
| 2011/0094406 | A1* | 4/2011 | Marya | F42B 1/02 102/305 |
| 2016/0010423 | A1* | 1/2016 | Myhre | E21B 43/117 166/285 |
| 2021/0032950 | A1* | 2/2021 | Rairigh | F42B 1/02 |
| 2021/0102434 | A1* | 4/2021 | Rairigh | F42C 19/0807 |
| 2022/0049566 | A1* | 2/2022 | Rairigh | F42B 3/02 |
| 2024/0209706 | A1* | 6/2024 | Rairigh | E21B 33/13 |

OTHER PUBLICATIONS

Wolterbeek et al., "Restoration of Annular Zonal Isolation Using Localized Casing Expansion (Lce) Technology: a Proof of Concept Based on Laboratory Studies and Field Trial Results", Journal of Petroleum Science and Engineering, 2021, vol. No. 197, 28 Pages.

* cited by examiner

METHOD OF CREATING A PLURALITY OF LONGITUDINALLY SEPARATED CIRCUMFERENTIAL DENTS IN A WELLBORE TUBULAR

CROSS REFERENCE TO RELATED APPLICATIONS

This is a National stage application of International Application No. PCT/EP2023/055994, filed 9 Mar. 2023, which claims priority of United States of America provisional Application No. 63/318,952 filed 11 Mar. 2022, which is incorporated herein by reference in its entirety.

FIELD OF THE INVENTION

The present invention relates to a method of creating a plurality of longitudinally separated circumferential dents in a wellbore tubular.

BACKGROUND TO THE INVENTION

Wellbore tubulars, such as production tubing, casing, and liners, are frequently used in construction and completion of boreholes in the Earth. In some operations, it is desired to create one or more circumferential dents in such wellbore tubulars after they have been placed in the borehole. Such dent is a circumferential protrusion of the wall of the wellbore tubular, formed by locally expanding the wellbore tubular to a larger outer diameter resulting in plastic deformation of the wellbore tubular. Dents can for example be used to close an annular space around the wellbore tubular to create an annular plug, for zonal isolation, or to remediate cavities in a hardened cement sheath which is already surrounding the wellbore tubular.

U.S. Pat. No. 11,002,097 discloses a method and a shaped charge assembly for selectively expanding a wall of a tubular. First and second explosive units are each symmetrical about an axis of revolution. Each explosive unit includes a top sub and a housing secured to the top sub. The external diameter of the housing is approximately equal to that of the top sub. Each housing houses a shaped charge formed adjacent to a backing plate. The explosive units each comprise a predetermined amount of explosive sufficient to expand, without puncturing, at least a portion of the wall of the tubular into a protrusion extending outward into an annulus adjacent the wall of the tubular. When both explosive units are detonated (sequentially or simultaneously), two protrusions are formed in the tubular separated by the same distance as the (axial) separation distance between the centers of mass of the shaped charges in first and second explosive units. Three explosive units may be joined together to create three axially separated circumferential protrusions.

SUMMARY OF THE INVENTION

The present invention provides a method of creating a plurality of longitudinally separated circumferential dents in a wellbore tubular, comprising:

providing a tool having a longitudinal tool axis and comprising at least a first charge housing and a second charge housing mechanically interconnected to each other by a longitudinal connecting rod, whereby the at first and second charge housings are separated from each other over a separation distance along the longitudinal tool axis, and wherein each of the first and second charge housings comprises at least one shaped charge;

inserting the tool in a wellbore tubular to a desired location within the wellbore tubular;

while the tool is inside the wellbore tubular, simultaneously detonating the at least one shaped charge in each of the at least two charge housings, whereby generating a first radial pressure wave from the first charge housing, in a first plane transverse to the longitudinal tool axis, and a first axial pressure wave propagating along the longitudinal tool axis toward the second charge housing, and whereby generating a second radial pressure wave from the second charge housing, in a second plane transverse to the longitudinal tool axis, and a second axial pressure wave propagating along the longitudinal tool axis toward the first charge housing;

whereby the first radial pressure wave causes a first circumferential dent in the wellbore tubular and whereby the second radial pressure wave causes a second circumferential dent in the wellbore tubular, and whereby the first and second axial pressure waves collide and thereby cause a third circumferential dent between the first and second circumferential dents.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

Figure 1:
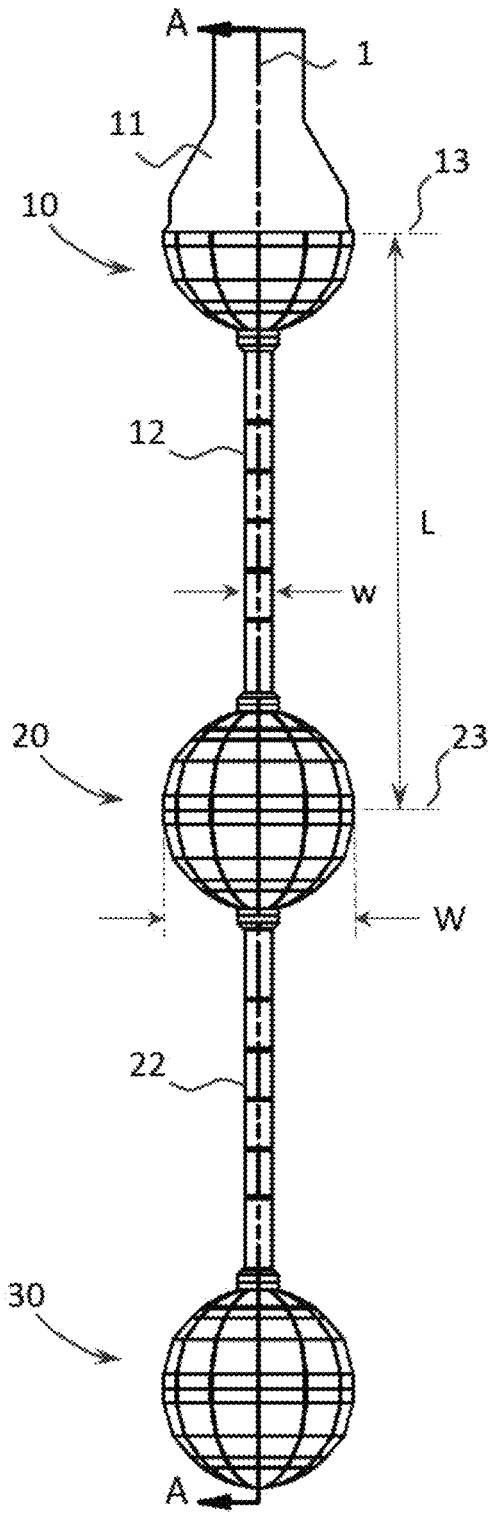
FIG. 1 schematically shows a side view of an example embodiment of a shaped charge assembly suitable for carrying out the method of the invention.

It has been discovered that by applying certain modifications to, for example, the tool of U.S. Pat. No. 11,002,097, it is possible with a string of just two axially separated charges to form an additional (third) dent in the wellbore tubular between the two dents that are created transversely to the shaped charges. Two additional axially separated dents may be created for each additional axially separated shaped charge that is added to the string. For example, by simultaneously detonating two shaped charges, it is possible to create three axially separated dents. By simultaneously detonating three shaped charges that are axially separated from each other, it is possible to create five axially separated dents. And so on. Generally the number of dents (N) created with the method according to the invention, can be equal to twice the number of axially separated shaped charges (M) minus one: N=2M−1.

Advantages of creating the additional dents with fewer charge housings, include:

- less debris may be formed, reducing the risk of a subsequent blockage in the wellbore;
- sealing capabilities caused by the dents is improved by the third dent without the need to include an additional charge housing; and
- fewer parts are required.

Relevant modifications to the tool of U.S. Pat. No. 11,002,097 include those that facilitate the formation and/or propagation of axial pressure waves from the shaped charges in the string, in addition to the radial pressure waves described in U.S. Pat. No. 11,002,097. Such axial pressure waves propagate along the longitudinal tool axis. The additional circumferential dent, between the circumferential dents that are transversely aligned with the shaped charges, forms in a third transverse plane, at the location where such axial pressure waves originating from two neighboring axially separated shaped charges collide.

Without wishing to be bound by theory, it is currently believed that a third radial pressure wave (or pressure burst) develops in the third plane (transverse to the longitudinal tool axis), as a result of the interaction between the colliding axial pressure waves. The third radial pressure wave emerges somewhere between two neighboring shaped charges. The exact location of the third radial pressure wave depends on the relative timing difference between detonation of the shaped charges, and the axial propagation velocity of the respective axial pressure waves. Assuming the latter is the same for both axial pressure waves, and the detonation of the respective shaped charges is exactly simultaneous, the axial pressure waves are expected to collide exactly midway between the two respective neighboring shaped charges. However, with a small timing difference in detonation, the axial pressure waves may collide somewhere closer than midway to one of the two shaped charges. Thus the relative location of the third dent may be influenced by choosing a timing difference. However, for the purpose of this specification, the term "simultaneous" is intended to mean a shaped charge is detonated exactly simultaneous with a neighboring axially separated shaped charge as well as practically simultaneous meaning that a shaped charge is detonated before it is reached by the axial pressure wave originating from said neighboring axially separated shaped charge. This covers all cases where two axial pressure waves can collide between the two neighboring shaped charges.

Possible relevant modifications that contribute to the formation and/or propagation of axial pressure waves from the shaped charges in the string include any one or any combination of the following.

A. The longitudinal connecting rod is preferably free from lateral flow-obstructing elements. Herewith, as must as possible the available energy in the axial pressure waves is preserved to be available for the third radial pressure wave.

B. The transverse width of the first and second charge housings is preferably at least 3× larger than a transverse width of the longitudinal connecting rod. This leaves sufficient room available within the charge housings for shaped charges to create axial pressure waves that can propagate on the outside of the longitudinal connection rod. In the tool of U.S. Pat. No. 11,002,097, the entire top sub, which approximately has the same diameter as the charge housing is situated between two successive neighboring charge housings. This blocks the axial waves.

C. The first and second charge housings are constructed from a low strength metal. Such a metal is relatively weak compared to typical tool steel, and as such it yields and ruptures easily under the explosions of the shaped charges. It thereby facilitates propagation of the longitudinally directed pressure waves. A typical tool steel, post heat treatment, has a minimum yield strength of about 1450 MPa at 20° C., and a ultimate tensile strength of about 1950 MPa at 20° C. The preferred low strength metal may have a minimum yield strength of less than 1300 MPa at 20° C. and/or an ultimate tensile strength of less than 1750 MPa at 20° C. In a preferred embodiment, the first and second charge housings are constructed from mild carbon steel, preferably having a minimum yield strength of less than 350 MPa at 20° C. and/or an ultimate tensile strength of less than 480 MPa at 20° C. A typical mild carbon steel has a minimum yield strength of about 330 MPa at 20° C. and a ultimate tensile strength of about 450 MPa at 20° C. In a more preferred embodiment, the low strength metal is relatively weak compared to mild carbon steel. The preferred low strength metal may have a minimum yield strength of less than 300 MPa at 20° C. and/or an ultimate tensile strength of less than 400 MPa at 20° C. Preferably, the low strength metal has a minimum yield strength of at least 150 MPa at 20° C. and/or an ultimate tensile strength of at least 200 MPa at 20° C., to ensure sufficient integrity of the charge housings as the tool is being deployed and run into the wellbore tubular.

D. The wall thickness of the first and second charge housings can be chosen commensurate with the strength of the material from which they are constructed, in order to achieve a desired collapse pressure and burst strength, which may be specified for certain wellbore conditions. Generally speaking, the wall thickness should be smaller for higher strength materials, and vice versa.

E. The first and second charge housings preferably have a spherical shape. A spherical shape serves to structurally support the charge housings against collapse under the increasing pressure of fluids in the wellbore, while at the same time minimizing the amount of material needed for the construction of the charge housings. The spherical shape allows for construction with smaller wall thickness and the burst pressure from the inside can be smaller, as a result, so that more of the explosive energy is preserved in the axial pressure waves.

F. The first and second charge housings are preferably constructed from a degradable metal. Such degradable metal degrades downhole in interaction with a wellbore fluid. The advantage is that such metal is relatively weak and as such it facilitates propagation of the longitudinally directed pressure waves. Furthermore, any debris left from the tool after detonating will eventually disappear from the well by degradation. Degradable metal is commercially available for frac barriers and frac balls. Known degradable materials include degradable metals, such as TervAlloy 3241 (Trademark). Suitable information may be available in one or more of U.S. Pat. Nos. 9,903,010; 10,150,713; and 9,757,796. Externally exposed surfaces of the degradable metal parts may be coated with a relatively thin layer of a non-degradable metal, so that the degradable metals are not exposed to the borehole fluids before detonating the shaped charges and forming the debris.

G. The separation distance between the first and second shaped charges preferably is at least 20 cm. This allows for sufficient time window that is available for the simultaneous detonation of two neighboring shaped charges. Also, there should be enough space available for the third dent to fully develop and for it to be fully separated from both of the first and second dents. Separation distance can be defined as the axial longitudinal distance between the centers of mass of respectively the first and second shaped charges. Preferably, the separation distance, while at least 20 cm, is not more than 100 cm, more preferably not more than 50 cm. Larger separation distances may be preferred from a point of view optimizing the sealing, but at the same time the axial pressure fronts may lose too much energy to be effective in forming the third dent to a sufficient depth.

H. Optimizing the shape of the shaped charges and the type and amount of backing plates, to control the pressure wave pattern and to focus the axial pressure waves. The latter can be achieved by tuning the shape of the concave outer surfaces of the shaped charges. This may require some trial and error. The backing plates may have concave surfaces facing away from the shaped charge.

I. The backing plates may be constructed from low strength material. The same definitions as defined in C above apply, but then applied to the backing plates instead of the housings.

J. The polar cavities above and/or below the backing plates (on the side facing away from the shaped charge) preferably have a significant amount of volume, to build up pressurized gas to promote the axial pressure waves. Only the cavities that face an adjacent charge housing need to be considered, i.e. only the polar cavities between the respective shaped charges and the longitudinal connecting rod are preferred to contain significant volume. How much volume is sufficient may be subject to some trial and error. The cavities are formed by "open" space around the shaped charge within the charge housing. The volumetric size of the polar cavities can be selected relative to the size of the toroidal (ring-shaped) cavity around the shaped charge, to balance the resulting axial pressure wave against the radial pressure wave produced by the shaped charge. The volume of one polar cavity (Vpc) may be chosen about equal to the volume of the toroidal cavity (Vtc). Generally, a good ratio Vpc/Vtc may be between 0.50 and 2.0. Preferably, $0.67<Vpc/Vtc<1.5$.

Each of these modifications contributes to the formation and propagation of the axial pressure waves, and having multiple of these modifications in place will further strengthen the ultimately resulting third radial pressure wave, or at least enhance the ability of the tool to generate the additional circumferential dent(s). However, no particular one or selection of these modifications is mandatory or otherwise to be regarded as essential.

FIG. 1 shows a side view of an example of a shaped charge assembly suitable for the method described herein. The term "tool" may be used to describe any shaped charge assembly suitable carrying out the method. The tool of FIG. 1 is described with reference to a longitudinal tool axis 1. It comprises a first charge housing 10 and a second charge housing 20 mechanically interconnected to each other by a first longitudinal connecting rod 12. The transverse heart planes 13 and 23 of, respectively, the first and second charge housings are separated from each other over an axial separation distance L along the longitudinal tool axis 1. The separation distance L in this example is 33 cm. It is envisaged that L will generally be selected within a range of from 20 cm to 100 cm.

The charge housings are in essence of a spherical design. The transverse width W (in this case, corresponding to the diameter at equator) of the charge housings, in this example, is 10.7 cm. The charge housings may be faceted on the external facing surfaces and/or be provided with break grooves as indicated by the grid patterns in FIG. 1 on the spherical external services. Such break grooves serve to ensure the debris will be of small enough size to easily drop down the wellbore tubular without causing an obstruction.

The connecting rod 12 is in essence cylindrical, and in this example it has a transverse width w (corresponding to outer diameter) of 1.5 cm. Generally, the ratio of W:w may be at least 3.0, preferably at least 6.0. A ratio of 3.0 is deemed sufficient, but a higher ratio is preferred to provide even more free space and less obstruction for the axial pressure wave to propagate. Preferably, sufficient lateral stiffness of the tool be able to avoid needing centralizers in the tool which could cause an unnecessary obstruction of the axial pressure waves and also unnecessarily create additional debris. The precise upper limit for the W:w ratio is difficult to mandate. It will depend on, for example, the elasticity of the materials used, the mass of the charge housings, and the overall tool length. However, generally, it is believed that W:w ratio of more than about 10 should be avoided, at least partly for the reasons given above.

The connecting rod 12 may also be provided with break grooves, in this case provided in the form of circumferential incisions. Such break grooves serve to ensure the debris will be of small enough size to easily drop down the wellbore tubular without causing an obstruction. Such break grooves do not significantly impede the axial pressure wave. The connecting rod 12 is as much as possible free from lateral flow-obstructing elements.

The first charge housing 10 includes a top sub 11 from which the rest of the tool is suspended. As can best be seen in FIG. 2, the top sub 11 may be provided with a threaded internal socket 14. This provides a secure mechanism for attaching the tool with an appropriate wire line, slick line, e-line, or tubing suspension string (not shown). Centralizers may suitably be employed overhead of the top sub 11, where they are less likely to be destroyed by the charges, to ensure the tool is axially aligned with the wellbore tubular.

The threaded internal socket 14 of the top sub 11 may connect to an internal bore 15 within the top sub 11, which in turn may connect with internal an internal bore 16 of the connecting rod 12. This way the second charge housing can be reached, e.g. for detonation cords (not shown). Detonator units (not shown) may also be held in the bore.

Figure 2:
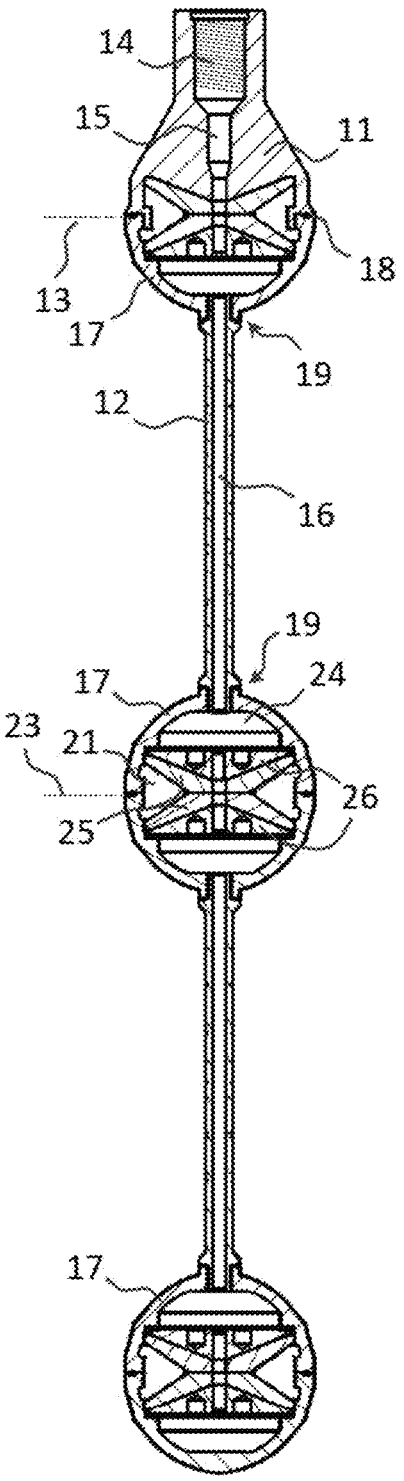
FIG. 2 schematically shows a cross sectional view A-A of the shaped charge assembly of FIG. 1.

As seen in FIG. 2, the charge housings may comprise shells 17, which may consist of two connecting shell halves, sealingly connected to each other with appropriate sealing means such as an O-ring 18. As needed, some of the shell halves may be provided with a threaded coupling 19 to receive one end of the connector rod 12.

Each of the first and second charge housings contains at least one shaped charge 25. Such shaped charge 25 is further described with reference to the second charge housing 20. Similar shaped charges are also applicable in the other charge housings. The shaped charges may typically comprise a precisely measured quantity of powdered, high explosive material, such as RDX, HNS or HMX. The quantity will be determined, in part, by the type and size of the target wellbore tubular that is to be dented with the tool. The explosive material may be formed into halves shaped as a truncated cone, by placing the explosive material in a press mold fixture. A backing plate 26 can then be placed over the explosive powder, after which the assembly subjected to a specified compression pressure. This pressed lamination comprises a half section of the shaped charge 25. The shaped charges can be commercially obtained upon request from specialist providers, including W.T. Bell International Inc. (Huntsville, Texas). Details can also be found in for example U.S. Pat. No. 11,002,097, which is incorporated herein by reference, as well as various other patents and documentation from W.T. Bell.

With the two halves brought together, the shaped charge 25 is a circular shaped unit with a V-shaped outer circumference to generate a radial pressure wave within the heart plane 23. At the same time, each half has a bowl shape facing the backing plate. This shape is capable of generating an axial pressure wave propagating upwards or downwards in longitudinal direction.

To further amplify the pressure waves, cavities are maintained within the charge housing around the charge 25. In addition to a toroidal cavity 21 around the shaped charge 25, there is also a polar cavity 24. On the inside, the toroidal cavity 21 is bound by the V-shaped outer circumference of the shaped charge 24, and on the outside the toroidal cavity 21 is bound by the charge housing shell 17. The polar cavity 24 is bound by the charge housing shell 17 and the backing plate 26. The polar cavity 24 is about equal in volume as the toroidal cavity 21.

Finally, it is noted that the example tool of FIGS. 1 and 2 further comprises a third charge housing 30 which is mechanically connected to the second charge housing 20 by a second longitudinal connecting rod 22. The same axial separation distance of 33 cm has been applied. The third charge housing 30 functions relative to the second charge housing 20 in the same way as the second charge housing 20 functions relative to the first charge housing 10.

For operation, the tool may be lowered in a wellbore tubular to a desired location within the wellbore tubular. Turing now to FIG. 3, the example tool is shown inserted in wellbore tubular 40, shown in cross section, schematically on a wireline 5, or any suitable suspension arrangement. The tool is schematically shown in silhouette, for reference. While the tool is inside the wellbore tubular 40, the at least one shaped charge in each of the charge housings 10,20,30 is simultaneously detonated as indicated schematically by explosion symbols 42. This generates a radial pressure wave 44 from each of the shaped charges in the charge housings. The radial pressure waves 44 each propagate predominantly in a plane 43 transverse to the longitudinal tool axis 1 and through the respective shaped charge. Generally, this plane may coincide with the transverse heart planes 13 and 23 of the respective charge housings. In addition, axial pressure waves 46, 47 are excited from the shaped charges. Each of the shaped charges may form a "downward" axial pressure wave 46 and an "upward" axial pressure wave 47 whereby "upward" merely means directed within the wellbore towards surface and "downward" is away from surface.

Figure 3:
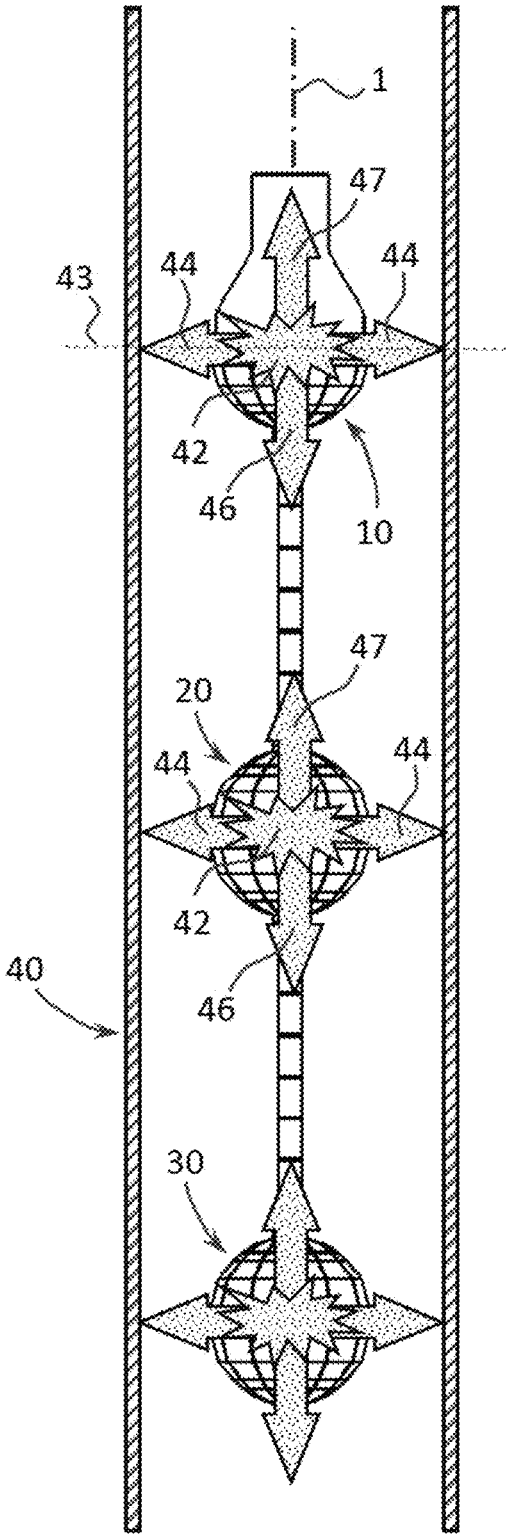
FIG. 3 schematically shows the example assembly of FIG. 1 in operation during an initial phase after detonation.
Figure 4:
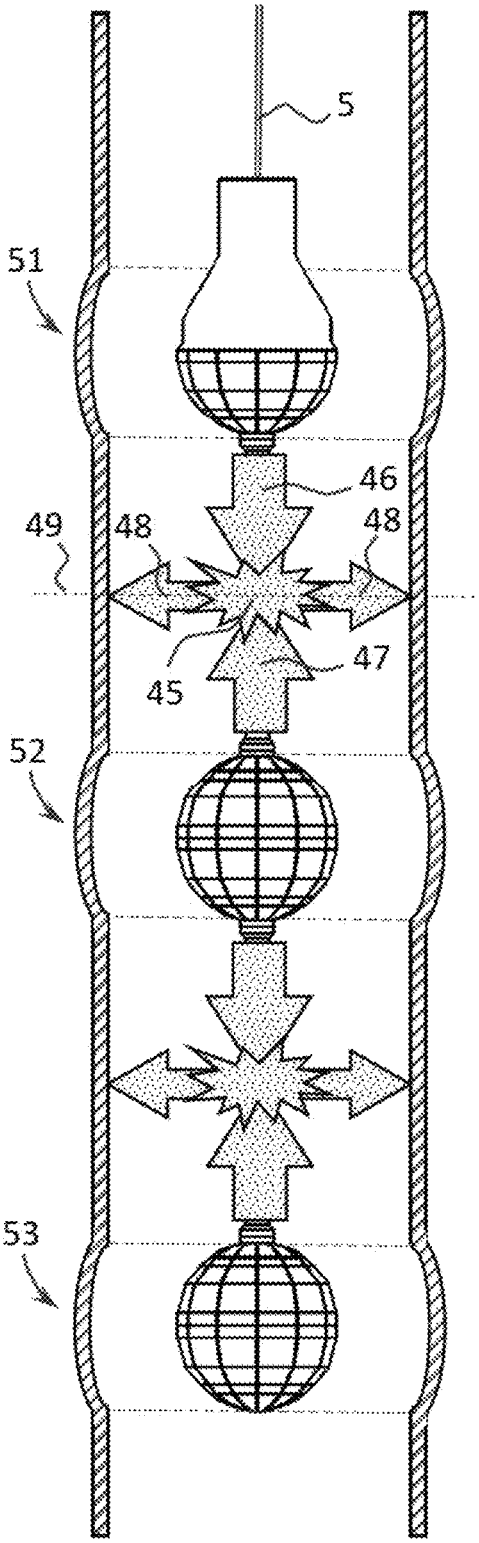
FIG. 4 schematically shows the example assembly of FIG. 1 in operation during a later phase after detonation.
Figure 5:
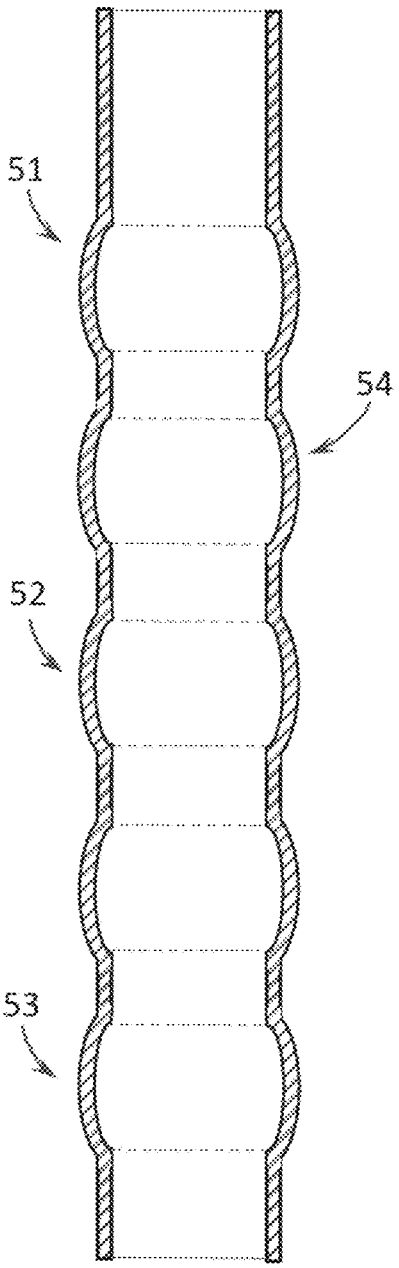
FIG. 5 schematically shows the wellbore tubular after operation of the tool of FIG. 1.

Turning now to FIG. 4, a slightly later stage of FIG. 3 is schematically shown. For reference, the tool is still shown, although in reality this tool would already be in the process of being shattered into debris. In the stage as depicted, it is assumed that the initial radial pressure waves 44 have reached the wellbore tubular and created circumferential dents 51, 52, 53 in the wellbore tubular. In addition, any downward axial pressure wave 46 will collide within the wellbore tubular with the upward axial pressure wave 47 of its neighboring charge housing. For example, a first axial pressure wave from the first charge housing 10 is propagating as downward axial wave 46 along the longitudinal tool axis 1 toward the second charge housing 20. A second axial pressure wave propagates upward from the second charge housing 20 along the longitudinal tool axis 1 toward the first charge housing 10. These first and second axial pressure waves collide and are believed to cause what effectively can be described as an additional radial pressure wave 48 (i.e. in this case a third radial pressure wave) in a further plane 49 transverse to the longitudinal tool axis 1. The collision is schematically shown at explosion symbol 45 in FIG. 4, although no shaped charge was actually present in the further plane 49. If this additional radial pressure wave 48 is sufficiently strong, it can cause an additional circumferential dent 54 between the first and second circumferential dents 51, 52, as shown in FIG. 5. A similar additional circumferential dent may be formed between the second and third circumferential dents 52, 53.

Figure 6:
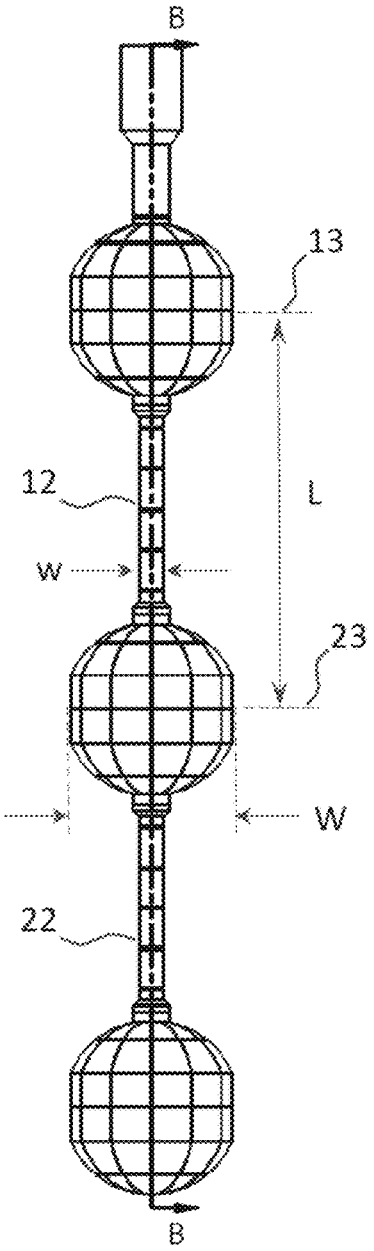
FIG. 6 schematically shows a side view of another example embodiment of a shaped charge assembly suitable for carrying out the method of the invention.
Figure 7:
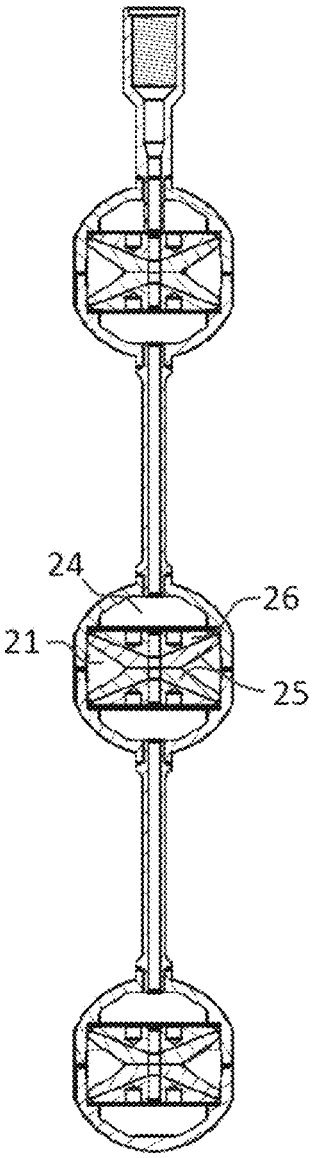
FIG. 7 schematically shows a cross sectional view B-B of the shaped charge assembly of FIG. 6.

FIGS. 6 and 7 show an alternative embodiment of a shaped charge assembly suitable for the method described herein. In this model, there is no top sub, but instead a half shell is provided with a relatively light pin with box connector. The first charge housing can now be identical, in structure and content, to the second charge housing in the sense that the shape is still optimized against collapse by external pressure. The charge housings are in essence still of spherical design, but a slight cylindrical section is provided which allows for slightly more space to house the shaped charges. The separation distance L of this particular version is 25 cm, and the transverse width W (in this case, corresponding to the outer diameter at the cylindrical sections) is 10.7 cm. The ratio W:w is 6.3. The charge housings and the separation rods were made out of TervAlloy dissolvable metal. The volume of one polar cavity 24 was 77% of the toroidal cavity 21 volume.

The tool of FIGS. 6 and 7 has been tested in an actual wellbore tubular cemented in a borehole. The wellbore tubular was a 5½ inch (approx. 14 cm outer diameter (OD)) casing of 17 lbs/ft (25 kg/m) L80 carbon steel. The tool was loaded with 3 shaped charges, each of 138 gram HMX. After running to the desired depth, the charges were detonated practically simultaneously, but as the detonation cord ran from the top, the first shaped charge detonated a fraction earlier than the second and then the third shaped charge. Several runs were made to various depths, being 1108 m (Run #1), 685 m (Run #2), 476 m (Run #3), with a tool made of TervAlloy 1132 FW+. Another run was made at 408 m (Run #4), using a tool that is normally identical to the tool of the Runs #1-#3 except that a is was constructed out of TervAlloy 3241 and a top sub was used instead of the pin. At the depth of Run #4, the wellbore tubular overlapped an outer wellbore tubular, whereas at the deeper depths the wellbore tubular was cemented against the formation with no intermediate tubing in between. Subsequently to firing the tools at these depth, the resulting wellbore tubular was measured with a multi-finger calliper tool to establish inner contours (full circle, over 360 azimuth) of the inside wall of the wellbore tubular over a longitudinal interval. From this, the minimum inner diameter (ID), the maximum ID and average ID can be derived at any longitudinal location (depth) within the wellbore tubular. The nominal ID of the wellbore tubular is 124.26 mm.

Figure 8:
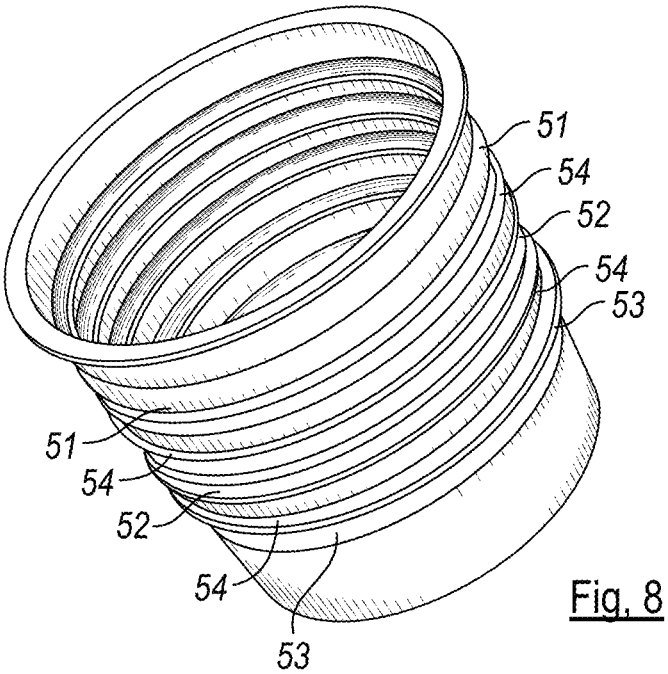
FIG. 8 shows a perspective view of a 3D representation of calliper measurements.
Figure 9A:
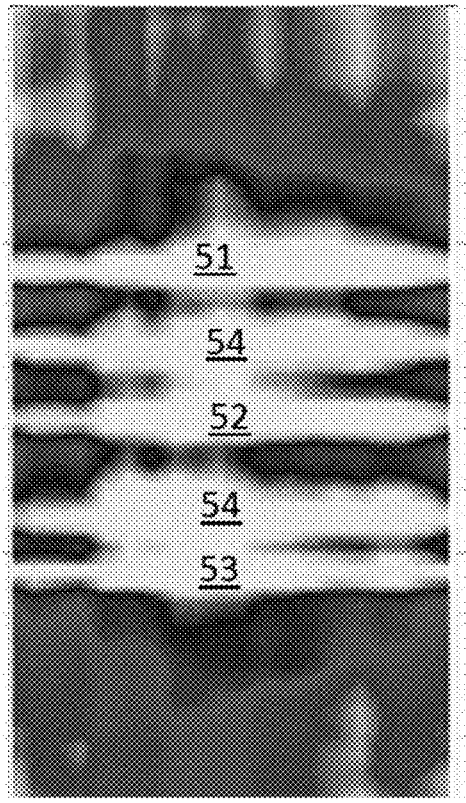
FIG. 9*a* shows calliper measurements mapped over longitudinal dimension (vertical) and azimuth (horizontal)
Figure 9B:
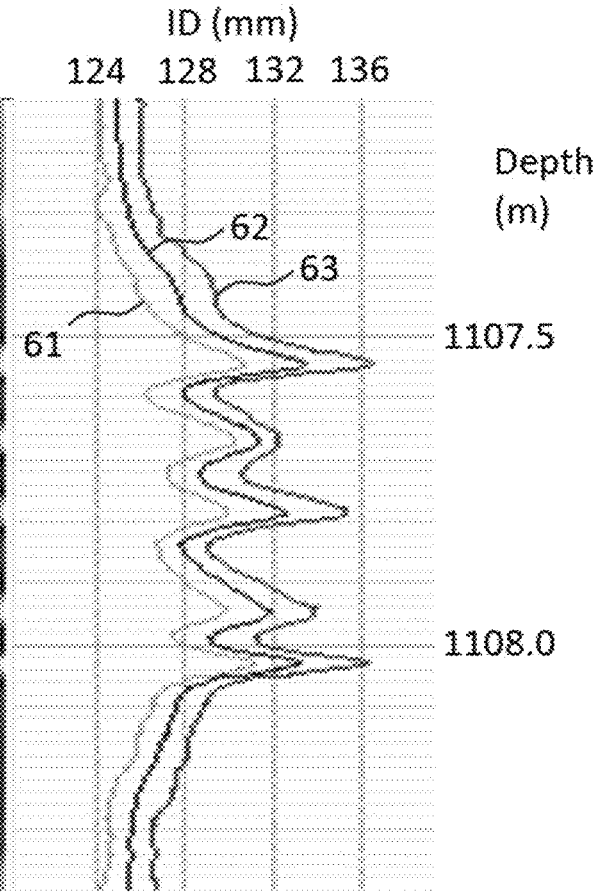
FIG. 9*b* shows a graph of minimum ID, average ID, and maximum ID for all azimuths at each longitudinal location as derived from FIG. 9*a;*

FIG. 8 shows a perspective view of a 3D representation of calliper measurements, whereby different greyscale values are used to represent the calliper measurements. The contours of the inside wall over a 1-m section in the vicinity of Run #1. Clearly visible are the first (51), second (52), and third (53) circumferential dents, as well as the two additional circumferential dents (54). FIGS. 9*a* and 9*b* show the results in a more quantitative representation. FIG. 9*a* shows the calliper measurements mapped over longitudinal dimension (vertical) and azimuth (horizontal). FIG. 9*b* shows a graph of minimum ID (curve 61), average ID (curve 62), and maximum ID (curve 63) as derived from the calliper results, as a function of longitudinal location (Depth). The average ID represents the average over all azimuths. While the primary circumferential dents 51, 52, 53 are somewhat more prominent, two additional circumferential dents 54 are also clearly established. The additional circumferential dent between the first and the second circumferential dents 51 and 52 is closer to the second circumferential dent 52 than to the first circumferential dent 51. Likewise, the additional circumferential dent between the second and the third circumferential dents 52 and 53 is closer to the third circumferential dent 53 than to the second circumferential dent 52. This is believed to be indicative of a minor detonation timing difference progressing from top to bottom.

Figures 10A, 10B:
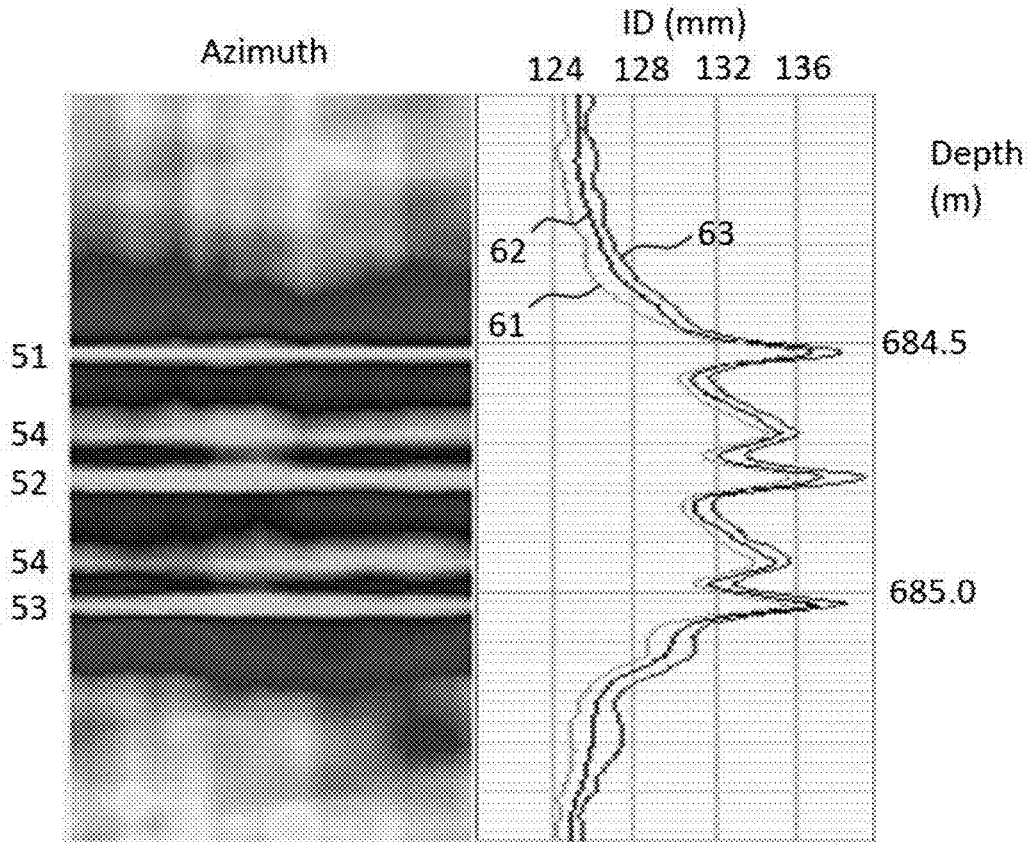
FIG. 10*a* shows calliper measurements mapped over longitudinal dimension (vertical) and azimuth (horizontal)
FIG. 10*b* shows a graph of minimum ID, average ID, and maximum ID for all azimuths at each longitudinal location as derived from FIG. 10*a;*

FIGS. 10*a* and 10*b* show the results for Run #2 over a 1-m longitudinal interval. In this run, it can be seen that the primary three circumferential dents 51, 52, 53 are more localized (narrower) than the additional circumferential dents 54. Also, the difference between the minimum ID and maximum ID is generally smaller than in Run #1. There is no clear reason to explain the difference. One untested hypothesis is that in Run #2 the tool may have been better centralized and/or axially aligned with the longitudinal axis of the wellbore tubular than in Run #1.

Figure 11:
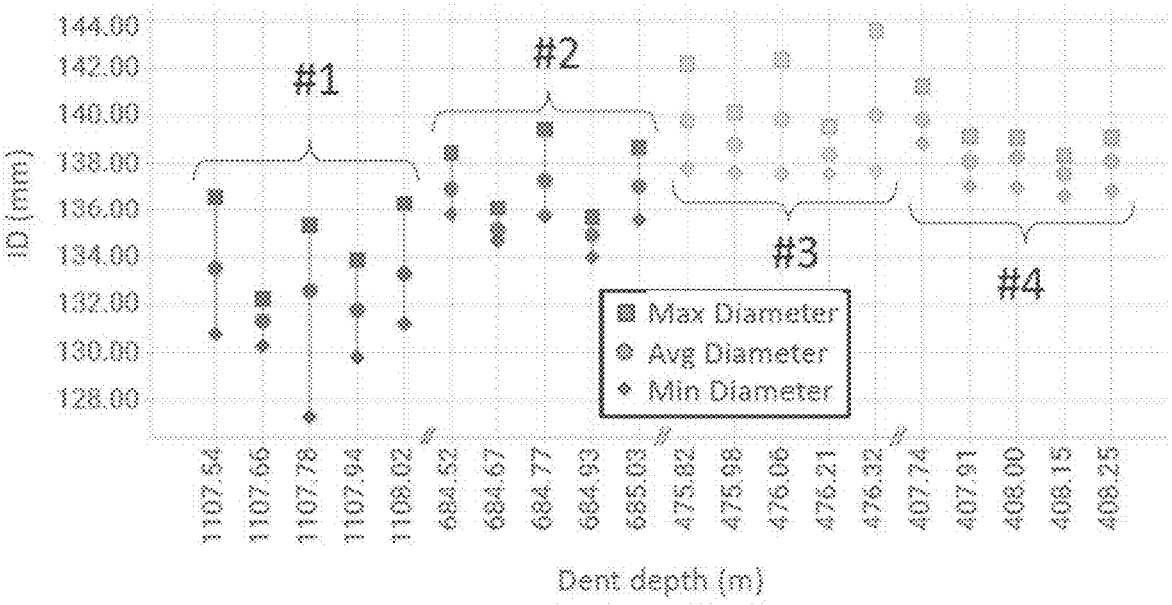
FIG. 11 shows a graph of minimum ID, average ID, and maximum ID for several runs.

A summary for all four runs is graphically represented in FIG. 11. Each run resulted in five distinct dents. The maximum ID (squares), average ID (dots), and minimum ID (diamonds) for each dent is plotted against depth of the dent. A general trend can be seen that the depth of the dents increases (i.e. ID increases) with decreasing Depth of the run. This is believed to be caused by lower hydrostatic pressure in the wellbore at lower depth. Run #4 cannot be compared to the other three runs, as in the case of Run #4 the wellbore tubular was cemented inside another wellbore tubular. Thus the cement sheath was less thick and there was another layer of steel close by. However, also in this case, five distinct dents were observed.

Figure 12:
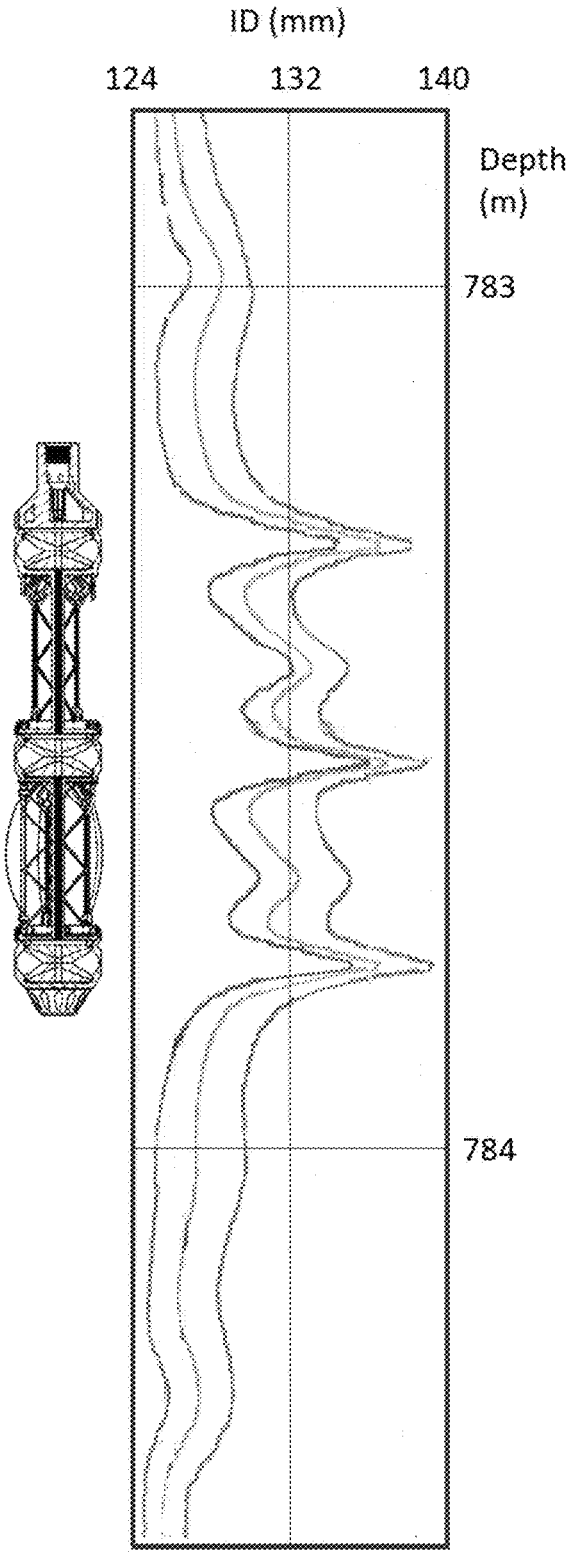
FIG. 12 shows an alternative shaped charge assembly and a corresponding a graph of minimum ID, average ID, and maximum ID for all azimuths at each longitudinal location.

For comparison, FIG. 12 shows calliper ID measurements over a longitudinal interval of 1.75 m around dents obtained with an alternative shaped charge arrangement as schematically depicted. In this case the casing (5½ inch OD) was 15.5 lbs/ft (23 kg/m) J55 carbon steel (nominal ID of 125.73 mm). Some of the main differences compared to the tool of FIGS. 6 and 7 include:

- the charge housings are of essentially cylindrical design instead of spherical design;
- there is almost no polar cavity above and below each shaped charge;
- the charge housings are separated from each other by means of a structural support frame;
- the axial separation distance L was 25.7 cm;
- four centralizer blades of spring steel are provided around the structural support frames to keep the tool concentric with the wellbore tubular; and
- a top sub is used (similar to the top sub of FIGS. 1 and 2 but with slightly larger OD).

The tool was 3D printed out of maraging steel. Due mainly to the structural support frames, the tool was stiffer and heavier than the tool of FIGS. 6 and 7. With this tool design, the additional circumferential dents are also observed, but somewhat less pronounced than in the case of the tool of FIGS. 6 and 7.

Figure 13:
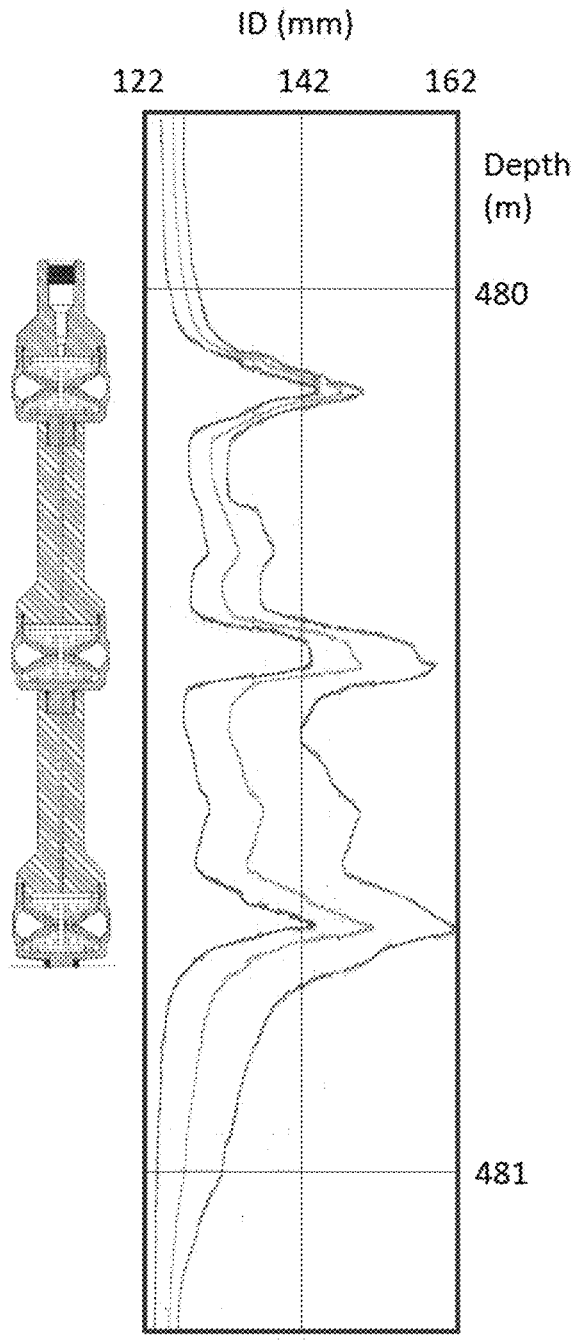
FIG. 13 shows an alternative shaped charge assembly and a corresponding a graph of minimum ID, average ID, and maximum ID for all azimuths at each longitudinal location.

For further comparison, FIG. 13 shows calliper ID measurements over a longitudinal interval of 1.35 m around dents obtained with an alternative shaped charge arrangement as schematically depicted. The casing was the same size and type as the one used for e.g. FIG. 10*b*. This version of the tool is closer to the reference tool as shown in FIG. 2H of U.S. Pat. No. 11,002,097, and it was constructed out of the same materials as the one of U.S. Pat. No. 11,002,097. Some of the main differences compared to the tool of U.S. Pat. No. 11,002,097 include:

- the narrower shaft of each top sub is longer than in U.S. Pat. No. 11,002,097, whereby increasing the axial separation distance L from about 10 cm to 30 cm;
- the shaped charges have more concavely shaped upward and downward directed faces.

Notable differences with the tool of FIGS. 6 and 7 include:

- the charge housings are of essentially cylindrical design instead of spherical design;
- very small polar cavities;
- massive top subs are provided on each charge housing;
- the housing around the toroidal cavity of each shaped charge is made of a frangible steel material of approximately 55-60 Rockwell "C" hardness;
- the top sub (including the integral connecting rod) is made of tool steel;
- the ratio W:w is only 2.1.

It can be seen in the calliper tool results that additional circumferential dents are only barely observed.

Figure 14:
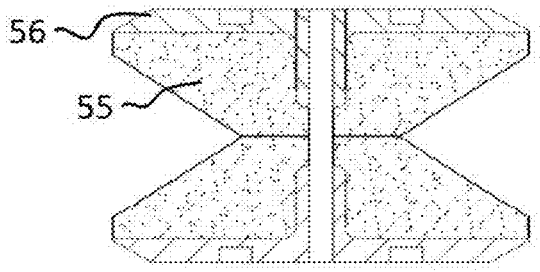
FIG. 14 shows yet another alternative shaped charge.
Figures 15A, 15B:
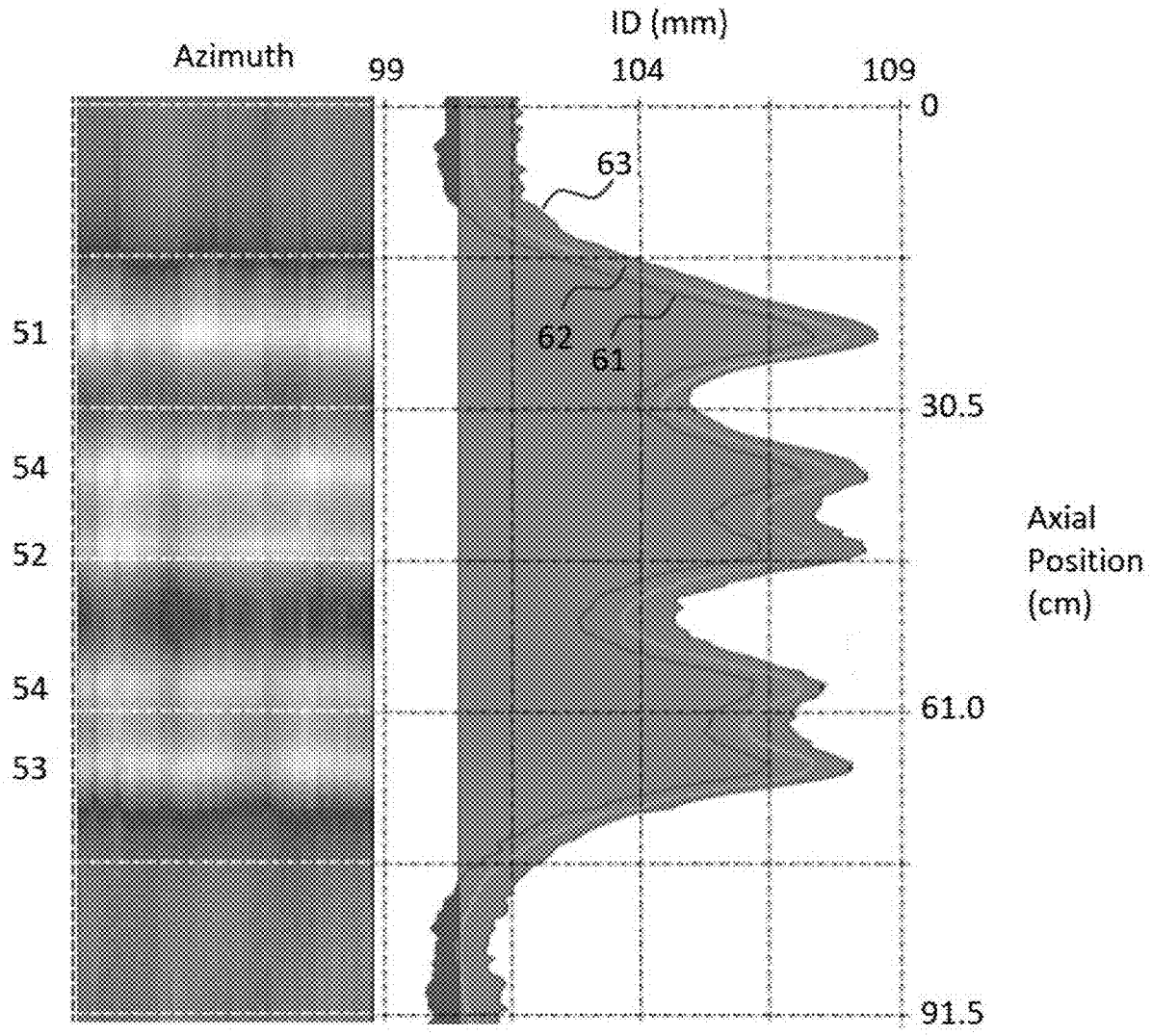
FIG. 15*a* shows calliper measurements mapped over longitudinal dimension (vertical) and azimuth (horizontal) for a tool employing the shaped charge of FIG. 14.
FIG. 15*b* shows a graph of minimum ID, average ID, and maximum ID for all azimuths at each longitudinal location as derived from FIG. 15*a*.

FIG. 14 shows a schematic cross section of another shaped charge geometry. This geometry employs essentially flat backing plates 56. The shaped charge 55 has a shape matched to the flat backing plates 56, and thus is somewhat thicker towards the central axis. The outer circumference of the shaped charge 55 defines a toroidal cavity 21 similar to the design of e.g. FIG. 7. Three of these units were mounted in a shaped charge assembly having the design and materials (Tervalloy 1132 FW+) similar to FIG. 7, but sized somewhat smaller. The axial separation distance L of the assembly was 21.9 cm and the transverse width W of the charge housings was 6.8 cm. The W:w ratio was 3.0. This assembly was tested in a 4½ inch OD casing of 13.5 lbs/ft (20 kg/m) P110 carbon steel (nominal ID of 99.57 mm) which was cemented concentrically inside a 7-inch casing. FIG. 15*a* shows the calliper measurements mapped over longitudinal dimension (vertical) and azimuth (horizontal) which clearly image the first, second, and third circumferential dents 51, 52, 53 and the two additional circumferential dents 54 between the first and second circumferential dents 51, 52 and the second and third circumferential dents 52, 53. FIG. 15*b* shows a graph of minimum ID, average ID, and maximum ID for all azimuths at each longitudinal location as derived from FIG. 15*a*. Interestingly, the additional circumferential dents 54 are almost identical in size compared to the neighboring circumferential dents 51, 52 and 53. In the previous examples shown in FIG. 9*b* and FIG. 10*b* the additional circumferential dents 54 were smaller in size compared to their neighboring circumferential dents 51, 52 and 53. This experimental data provides evidence that the additional circumferential dent size can be manipulated and improved with the discussed design changes.

Certain design features of the modified tools used hereinabove may have been subject to prior disclosure. Reference is made to, for example, US pre-grant publication No. 2022/0049566 A1. However, the specific use of such tools to generate first and second axial pressure waves which collide, and thereby cause additional circumferential dents has not been disclosed before.

Finally, to understand the pressure waves around each shaped charge, a finite element simulation has been run using LS-DYNA software. In the simulation configuration, a 4½ inch OD (115 mm) L80 casing 11.6 lbs/ft (17.2 kg/m) submerged in 100 bar water, was expanded using a charge of 72 g liner-less HMX. The simulation vessel ID was 8 inch (approx. 203 mm), and the length of the casing section was 20 inch (508 mm).

Figure 16A:
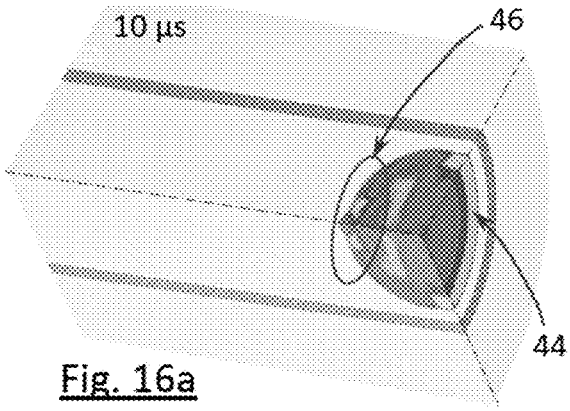
FIGS. 16*a* to 16*f* show results of a pressure wave simulation at various times after a detonation.
Figure 16B:
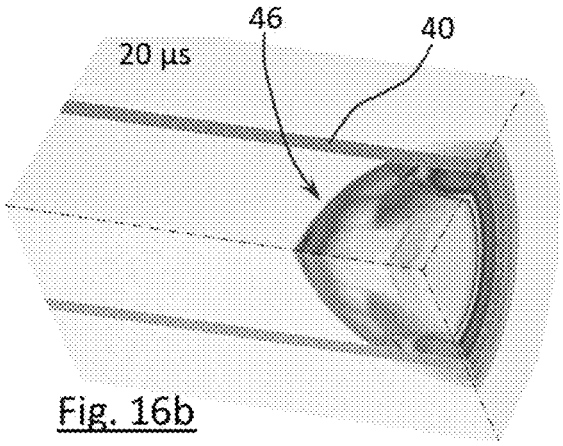
Figure 16C:
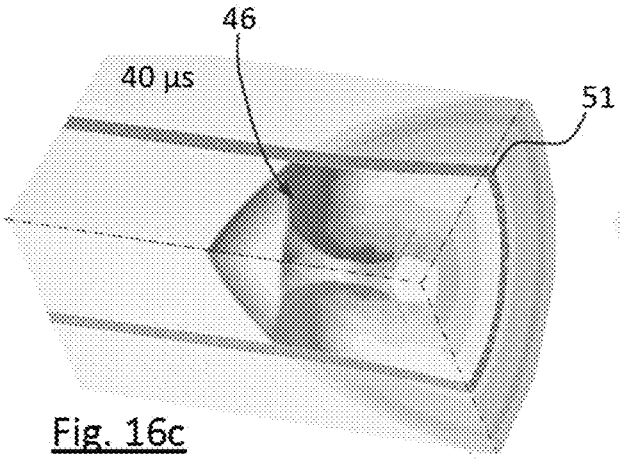
Figure 16D:
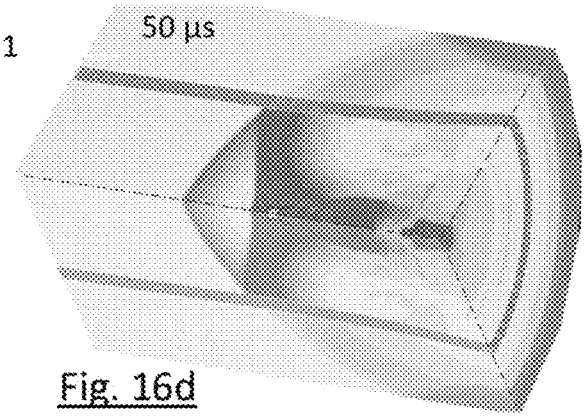
Figure 16E:
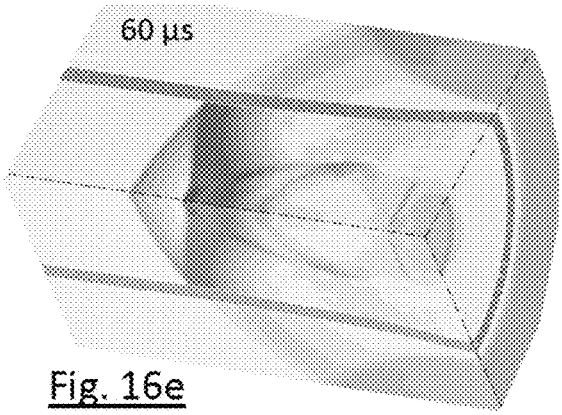
Figure 16F:
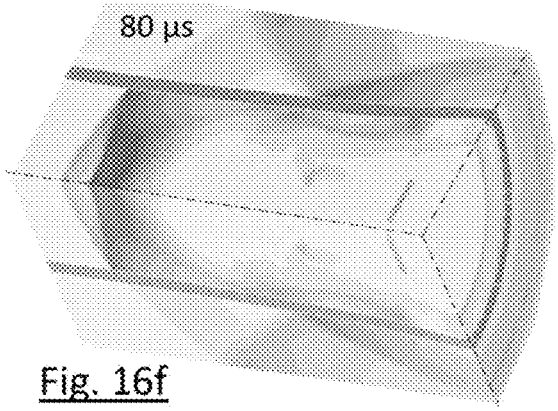

FIGS. 16*a* to 16*f* show stills of the pressure intensity at various durations after detonation ranging from 10 μs (FIG. 16*a*) to 80 μs (FIG. 16*f*). In FIG. 16*a*, the doughnut (torus) of the radial pressure wave 44 can be clearly distinguished as well as the beginning of the axial pressure wave 46. In FIG. 16*b*, at 20 μs, the radial pressure wave 44 has reached and started to impact the wellbore tubular. The axial pressure wave 46 is starting to develop more. In FIG. 16*c*, at 40 μs, the first circumferential dent 51 has formed. At that time, the axial pressure wave has fully developed, and it is propagating axially through the wellbore tubular. The propagation is confirmed by the next three snapshots in FIGS. 16*d* to 16*f*. A careful analysis of the wellbore tubular shows that, even where the radial pressure wave 44 has not directly impacted the wellbore tubular 40, there is already an onset of plastic yielding of the wellbore tubular 40 caused by the axial pressure wave 46. This effect in itself may be sufficient to close at least some of the micro annuli that may be further removed from the direct vicinity of the circumferential dent 51.

The person skilled in the art will readily understand that, while the detailed description of the invention will be illustrated making reference to one or more embodiments, each having specific combinations of features and measures, many of those features and measures can be equally or similarly applied independently in other embodiments or combinations.

We claim:

1. A method of creating a plurality of longitudinally separated circumferential dents in a wellbore tubular, comprising:

providing a tool having a longitudinal tool axis and comprising at least a first charge housing and a second charge housing mechanically interconnected to each other by a longitudinal connecting rod, whereby the first and second charge housings are separated from each other over a separation distance along the longitudinal tool axis, and wherein each of the first and second charge housings comprises at least one shaped charge;

inserting the tool in a wellbore tubular to a desired location within the wellbore tubular;

while the tool is inside the wellbore tubular, simultaneously detonating the at least one shaped charge in each of the at least two charge housings, whereby generating a first radial pressure wave from the first charge housing, in a first plane transverse to the longitudinal tool axis, and a first axial pressure wave propagating along the longitudinal tool axis toward the second charge housing, and whereby generating a second radial pressure wave from the second charge housing, in a second plane transverse to the longitudinal tool axis, and a second axial pressure wave propagating along the longitudinal tool axis toward the first charge housing;

whereby the first radial pressure wave causes a first circumferential dent in the wellbore tubular and whereby the second radial pressure wave causes a second circumferential dent in the wellbore tubular, and whereby the first and second axial pressure waves collide and thereby cause a third circumferential dent between the first and second circumferential dents.

2. The method of claim 1, wherein a longitudinal connecting rod is free from lateral flow-obstructing elements.

3. The method of claim 1, wherein a transverse width of the first and second charge housings is at least 3× larger than a transverse width of the longitudinal connecting rod.

4. The method of claim 1, wherein the first and second charge housings are constructed from a low strength metal, wherein said low strength metal has a minimum yield strength of less than 1300 MPa at 20° C. and/or an ultimate tensile strength of less than 1750 MPa at 20° C.

5. The method of claim 1, wherein the first and second charge housings are constructed from a low strength metal, wherein said low strength metal has a minimum yield strength of less than 300 MPa at 20° C. and/or an ultimate tensile strength of less than 400 MPa at 20° C.

6. The method of claim 4, wherein said low strength metal has a minimum yield strength of at least 150 MPa at 20° C. and/or an ultimate tensile strength of at least 200 MPa at 20° C.

7. The method of claim 1, wherein the first and second charge housings have a spherical shape.

8. The method of claim 1, wherein the first and second charge housings are constructed from a degradable metal.

9. The method of claim 1, wherein the separation distance is at least 20 cm.

10. The method of claim 1, wherein a polar cavity and a toroidal cavity are provided between each shaped charge and the charge housing in which the shaped charge is arranged, wherein a ratio of a volume of said polar cavity and a volume of said toroidal cavity is between 0.50 and 2.0.

11. The method of claim 1, wherein said wellbore tubular is cemented in a borehole in the earth, whereby the wellbore tubular is surrounded by a sheath of cement, and whereby the circumferential dents cause the cement to densify locally where the dents impact the sheath of cement.

* * * * *